US009971281B2

(12) United States Patent
Yada et al.

(10) Patent No.: US 9,971,281 B2
(45) Date of Patent: May 15, 2018

(54) DEVELOPER CONTAINER, DEVELOPING DEVICE, PROCESS CARTRIDGE, AND IMAGE FORMING APPARATUS

(71) Applicant: CANON KABUSHIKI KAISHA, Tokyo (JP)

(72) Inventors: Takayuki Yada, Suntou-gun (JP); Tetsuya Numata, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/426,682

(22) Filed: Feb. 7, 2017

(65) Prior Publication Data

US 2017/0242369 A1 Aug. 24, 2017

(30) Foreign Application Priority Data

Feb. 22, 2016 (JP) ..... 2016-030701
Jan. 18, 2017 (JP) ..... 2017-006586

(51) Int. Cl.
*G03G 15/08* (2006.01)

(52) U.S. Cl.
CPC ..... *G03G 15/0891* (2013.01); *G03G 15/0875* (2013.01)

(58) Field of Classification Search
CPC ..... G03G 15/0891; G03G 15/0875
See application file for complete search history.

(56) References Cited

U.S. PATENT DOCUMENTS

2014/0212166 A1* 7/2014 Takeuchi ..... G03G 15/0898 399/106

FOREIGN PATENT DOCUMENTS

JP 2003202737 A 7/2003
JP 2006064740 A 3/2006

* cited by examiner

*Primary Examiner* — Clayton E Laballe
*Assistant Examiner* — Jas Sanghera
(74) *Attorney, Agent, or Firm* — Rossi, Kimms & McDowell LLP

(57) ABSTRACT

Provided is a developer container, including: a conveyance member configured to convey a developer; a vibration member arranged along an inclined surface opposed to the conveyance member and configured to vibrate through contact with the conveyance member; and a protruding portion protruding from the inclined surface and configured to be held in contact with the vibration member, wherein the conveyance member is a flexible sheet-like member, wherein, under a state in which the vibration member is brought into contact with the protruding portion, a first gap and a second gap are formed between the vibration member and the inclined surface with the protruding portion as a boundary, and wherein at least a part of the first gap and the second gap is located in a region of a rotation locus of the conveyance member.

22 Claims, 13 Drawing Sheets

DEVELOPER CONTAINER, DEVELOPING DEVICE, PROCESS CARTRIDGE, AND IMAGE FORMING APPARATUS

BACKGROUND OF THE INVENTION

Field of the Invention

The present invention relates to a developer container, a developing device, a process cartridge, and an image forming apparatus using those.

For example, there has been provided a process cartridge, which integrally includes as cartridge an electrophotographic photosensitive drum and at least one of a developing unit, a charging unit, and a cleaning unit serving as image forming process units configured to act on the electrophotographic photosensitive drum. This process cartridge is removably mounted to an image forming apparatus main body. Further, an electrophotographic image forming apparatus is configured to form an image on a recording material through use of an electrophotographic image forming method. Examples of the electrophotographic image forming apparatus may include an electrophotographic copying machine, an electrophotographic printer such as a light emitting diode (LED) printer and a laser beam printer, a facsimile machine, and a word processor.

Description of the Related Art

In the electrophotographic image forming apparatus (hereinafter simply referred to as "image forming apparatus"), a surface of a photosensitive drum, which serves as an image bearing member and is generally formed of a drum-type electrophotographic photosensitive member, is uniformly charged. Next, the charged surface of the photosensitive drum is selectively exposed to light, thereby forming an electrostatic latent image on the surface of the photosensitive drum. Next, the electrostatic latent image formed on the surface of the photosensitive drum is developed into a toner image with toner serving as a developer. Then, the toner image formed on the surface of the photosensitive drum is transferred onto a recording material such as a recording sheet or a plastic sheet. Further, the toner image transferred onto the recording material is heated and pressurized so that the toner image is fixed on the recording material. In such a manner, image recording is performed.

In general, the image forming apparatus requires toner refilling and maintenance for various types of image forming process units. In order to enable easy toner refilling and maintenance, there has been practically used a process cartridge, which integrally includes a photosensitive drum, a charging unit, a developing unit, and a cleaning unit in a frame body and is removably mounted to an image forming apparatus main body.

The process cartridge type enables a user to perform maintenance for the image forming apparatus. Thus, operability can significantly be improved, thereby being capable of providing an image forming apparatus which is excellent in usability. Therefore, the process cartridge type is widely employed in the image forming apparatus. With regard to the process cartridge, there has been proposed, in Japanese Patent Application Laid-Open No. 2003-202737, a technology for reducing residual toner on a slant surface of an inner wall surface of a developer container. According to Japanese Patent Application Laid-Open No. 2003-202737, an elastic member is arranged between a sheet-like member, which is arranged in a vibratable manner on the slant surface of the inner wall surface of the developer container, and the slant surface of the developer container.

However, according to Japanese Patent Application Laid-Open No. 2003-202737, a stirring member is brought into contact with only a distal edge side of the sheet-like member with respect to the elastic member to vibrate the sheet-like member. Therefore, only one vibration can be generated by one rotation of the stirring member.

SUMMARY OF THE INVENTION

The present invention has been made to solve the above-mentioned problem, and has an object to provide a developer container capable of causing more vibration in a vibration member, which is arranged in a vibratable manner along an inclined surface in the developer container, by one rotation of a conveyance member.

According to one embodiment of the present invention, there is provided a developer container, including: a conveyance member configured to convey a developer; a vibration member arranged along an inclined surface opposed to the conveyance member and configured to vibrate through contact with the conveyance member; and a protruding portion protruding from the inclined surface and configured to be held in contact with the vibration member, wherein the conveyance member is a flexible sheet-like member, wherein, under a state in which the vibration member is brought into contact with the protruding portion, a first gap and a second gap are formed between the vibration member and the inclined surface with the protruding portion as a boundary, and wherein at least a part of the first gap and the second gap is located in a region of a rotation locus of the conveyance member.

According to another embodiment of the present invention, there is provided a developing device, including: the developer container; and a developer bearing member arranged in the developer container so as to be opposed to an image bearing member.

According to another embodiment of the present invention, there is provided a process cartridge removably mounted to a main body of an image forming apparatus, including: the developer container; and an image bearing member on which an electrostatic latent image is to be formed.

According to another embodiment of the present invention, there is provided an image forming apparatus configured to form an image on a recording material, including: at least one of the developer container, the developing device, and the process cartridge, which are configured to be removably mounted to the image forming apparatus.

According to another embodiment of the present invention, there is provided a developing device, including: a developer bearing member; a container configured to store a developer and provided with an opening; a conveyance member arranged in the container and configured to convey the developer; a vibration member arranged along an inclined surface in the container and configured to vibrate through contact with the conveyance member; a protruding portion protruding from the inclined surface and configured to be held in contact with the vibration member, wherein the conveyance member is a flexible sheet-like member, wherein, under a state in which the vibration member is held in contact with the protruding portion, a first gap and a second gap are formed between the vibration member and the inclined surface with the protruding portion being a boundary, and wherein at least a part of the first gap and the second gap is located in a region of a rotation locus of the conveyance member.

Further features of the present invention will become apparent from the following description of exemplary embodiments with reference to the attached drawings.

DESCRIPTION OF THE EMBODIMENTS

With reference to the drawings, specific description is made of an image forming apparatus including a developer container, a developing device, and a process cartridge, which are removably mounted to the image forming apparatus according to one embodiment of the present invention. In the following embodiment, description is made of one example of a process cartridge B including a developing device 20 with a developer container 12. However, the developing device 20 is not limited thereto, and may have a configuration including a developing roller 32 serving as a developer bearing member and a frame body configured to store a developer. Further, it is only necessary that the process cartridge B include at least a photosensitive drum 62 serving as an image bearing member.

In the following description, functions, materials, shapes, and relative arrangement of components are not intended to limit the scope of the invention only to those unless specific description is otherwise given. A rotation axis direction of the photosensitive drum serving as the image bearing member is referred to as a longitudinal direction. In the longitudinal direction, a side on which the photosensitive drum receives a driving force from the image forming apparatus main body is referred to as a drive side, and a side opposite to the drive side is referred to as a non-drive side.

<Image Forming Apparatus>

Figure 1:
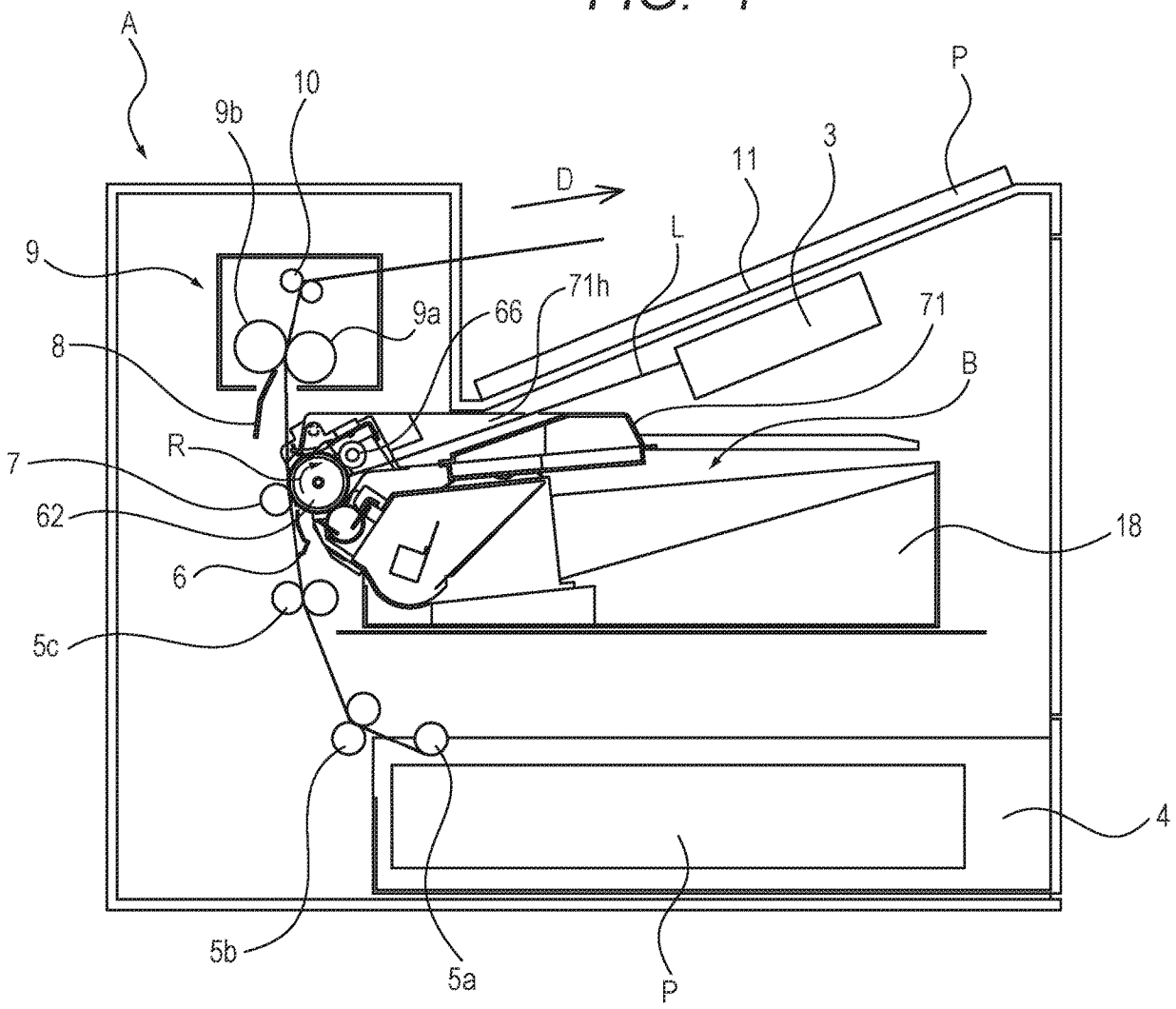
FIG. 1 is an explanatory sectional view for illustrating a configuration of an image forming apparatus which includes a process cartridge removably mounted thereto according to an embodiment of the present invention.
Figure 2:
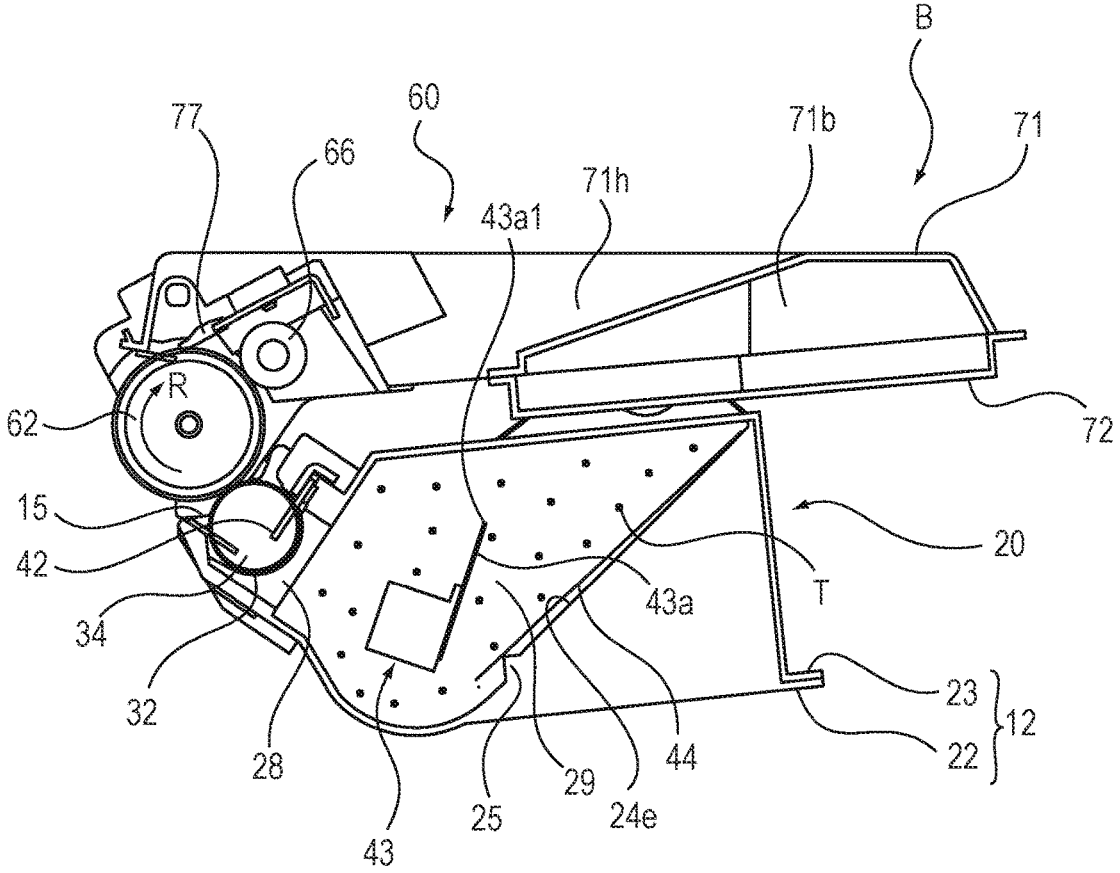
FIG. 2 is an explanatory sectional view for illustrating a configuration of the process cartridge according to this embodiment.

With reference to FIG. 1 and FIG. 2, description is made of a configuration of the image forming apparatus including the developer container, the developing device, and the process cartridge, which are removably mounted to the image forming apparatus according to one embodiment of the present invention. FIG. 1 is an explanatory sectional view for illustrating configurations an electrophotographic image forming apparatus (hereinafter referred to as "image forming apparatus") A and the process cartridge B removably mounted to an image forming apparatus A main body (main body of the image forming apparatus) according to this embodiment. FIG. 2 is an explanatory sectional view for illustrating a configuration of the process cartridge B. In the following description, the image forming apparatus A main body is a part of the image forming apparatus A excluding the process cartridge B.

The image forming apparatus A illustrated in FIG. 1 is one example of a laser beam printer, which employs an electrophotographic method and is configured so that the process cartridge B is removably mounted to the image forming apparatus A main body. The process cartridge B is mounted to the image forming apparatus A main body. In the process cartridge B, there is arranged the photosensitive drum 62 serving as the image bearing member on which an electrostatic image is to be formed. A laser scanner unit 3, which serves as an image exposure unit and is configured to form the electrostatic latent image on a surface of the photosensitive drum 62, is arranged in the image forming apparatus A main body. A feeding tray 4, which is configured to store recording materials P, is arranged below the process cartridge B.

A pickup roller 5*a* is arranged in the image forming apparatus A main body. The pickup roller 5*a* is configured to separate the recording materials P, which are stored in the feeding tray 4, one by one with a separation unit (not shown) and to feed the recording materials P along a conveyance direction D of the recording materials P. Further, conveyance rollers 5*b*, registration rollers 5*c*, a transfer guide 6, a transfer roller 7 serving as a transferring unit, a conveyance guide 8, a fixing device 9 serving as a fixing unit, a delivery roller 10, and a delivery tray 11 are sequentially arranged. The fixing device 9 includes a heating roller 9*a* and a pressure roller 9*b*.

<Image Forming Operation>

An image forming operation of the image forming apparatus A is described. In accordance with a printing start signal transmitted from a personal computer arranged outside, the photosensitive drum 62 is driven to rotate at a predetermined peripheral speed (process speed) in a direction of the arrow R of FIG. 1 and FIG. 2. A charging roller 66, which serves as a charging unit and has a charging bias voltage applied thereto by a charging bias power source (not shown), is brought into contact with the surface of the photosensitive drum 62 to uniformly charge the surface of the photosensitive drum 62.

The laser scanner unit 3 is configured to output a laser light L corresponding to image information. The laser light L emitted from the laser scanner unit 3 passes through an opening 71*h* formed in a cleaning frame body 71 constructing the process cartridge B to optically scan and expose the surface of the photosensitive drum 62. With this, the surface of the photosensitive drum 62 uniformly charged by the charging roller 66 is exposed with the laser light L corresponding to the image information, and an electrostatic latent image is formed thereon.

As illustrated in FIG. 2, in the developing device 20 serving as a developing unit, toner T serving as the developer is stored as follows in a stirring chamber 29 of the developer container 12 configured to store the toner T. There is arranged a conveyance member 43 configured to convey the toner T toward an opening 15 formed at a part of the developer container 12 including a bottom member 22 and an upper container 23. A rotation operation of the conveyance member 43 and a vibration operation of the vibration member 44, which is formed of a sheet-like member, cause the toner T stored in the stirring chamber 29 to be stirred and conveyed.

With this, the toner T is delivered to a developing chamber 28 in which the developing roller 32 serving as the developer bearing member is arranged. The developing roller 32 is arranged in the developer container so as to be opposed to the surface of the photosensitive drum 62. A part of the developing roller 32 is arranged so as to be exposed through the opening 15 and opposed to the surface of the photosensitive drum 62. The conveyance member 43 is rotatably arranged in the developer container 12 and is configured to convey the toner T (developer). The conveyance member 43 is arranged so that an axis direction of the conveyance member 43 is parallel to an axis direction of the photosensitive drum 62.

The developing device 20 of this embodiment includes at least the developer container 12 and the developing roller 32. The developer container 12 is configured to store the toner T and includes the bottom member 22 and the upper container 23. The developing roller 32 is rotatably arranged in the developing chamber 28 of the developer container 12 so as to be opposed to the surface of the photosensitive drum 62. The process cartridge B further includes at least the photosensitive drum 62 in the developing device 20 of this embodiment. Further, the process cartridge B is arranged so as to be individually and removably mounted to the image forming apparatus A main body. As a matter of course, the developing device 20 may solely be mounted and removed with respect to the image forming apparatus A main body.

The toner T in the developing chamber 28 is borne on the surface of the developing roller 32 by a magnetic force of a magnet roller 34, which is built the developing roller 32 and formed of a stationary magnet. The toner T borne on the surface of the developing roller is charged with friction and regulated in layer thickness on the surface of the developing roller 32 by a developing blade 42. A developing bias voltage is applied to the developing roller 32 by a developing bias power source (not shown). With this, the toner T borne on the surface of the developing roller 32 is supplied onto the electrostatic latent image formed on the surface of the photosensitive drum 62. Thus, the electrostatic latent image is developed as a toner image and formed into a visible image.

As illustrated in FIG. 1, the laser light L is emitted from the laser scanner unit 3. In matching with an output timing of the laser light L, the recording material P, which is stored in the feeding tray 4 arranged in a lower portion of the image forming apparatus A main body, sent out by the pickup roller 5*a*. After that, the recording materials P are fed one by one in cooperation with the separation unit (not shown). Further, the recording material P is conveyed by the conveyance roller 5*b*, and a leading edge of the recording material P is brought into abutment against a nip portion of the registration rollers 5*c* which are temporarily stopped. With this, the recording material P is put through the nip portion by its stiffness, and a skew feed is corrected.

After that, the registration rollers 5*c* are rotated at a predetermined timing, and the recording material P is nipped and conveyed by the registration rollers 5*c*. After that, the recording material P is guided by the transfer guide 6 and conveyed to a transfer position which is formed of a nip portion between the photosensitive drum 62 and the transfer roller 7. At the transfer position, a transfer bias voltage is applied from a transfer bias power source (not shown) to the transfer roller 7. With this, the toner image formed on the surface of the photosensitive drum 62 is transferred onto the recording material P.

The recording material P having the toner image transferred thereon is separated from the surface of the photosensitive drum 62 and conveyed along the conveyance guide 8 to the fixing device 9. Then, the recording material P is heated and pressurized in the course of being nipped and conveyed by the heating roller 9*a* and the pressure roller 9*b* constructing the fixing device 9, with the result that the toner T is thermally melted and fixed on the recording material P. With this, an image is formed on the recording material P. The recording material P having the toner image fixed thereon is conveyed by the delivery roller 10 and delivered to the delivery tray 11.

As illustrated in FIG. 2, residual toner, which remains on the surface of the photosensitive drum 62 after the toner image is transferred onto the recording material P, is scraped off and removed by a cleaning blade 77 serving as a cleaning unit, and is used again for the image forming process. The residual toner removed from the surface of the photosensitive drum 62 is stored in a waste toner chamber 71*b* formed in the cleaning unit 60. In this embodiment, the charging roller 66, the developing roller 32, the transfer roller 7, and the cleaning blade 77 construct an image forming process unit which acts on the photosensitive drum 62.

<Operations of Mounting and Removing Process Cartridge>

Figure 3:
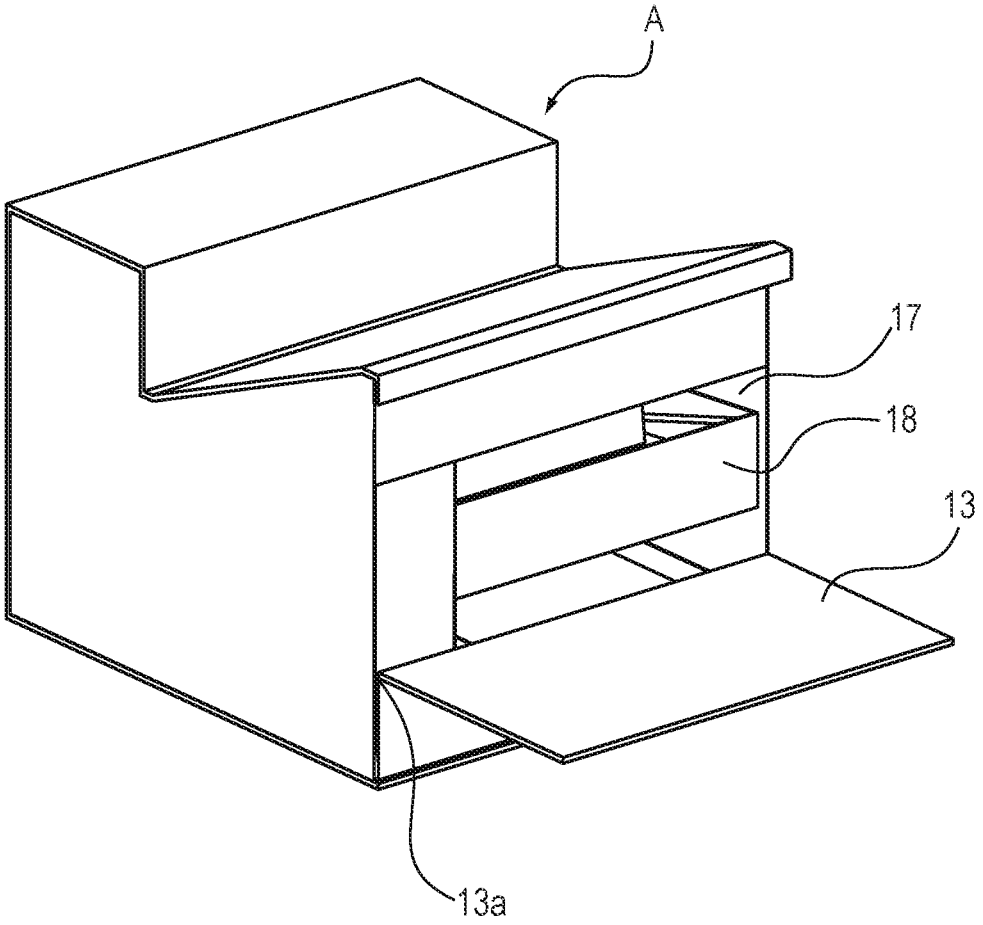
FIG. 3 is an explanatory perspective view for illustrating a state in which an openable and closable door of the image forming apparatus is opened according to this embodiment.
Figure 4:
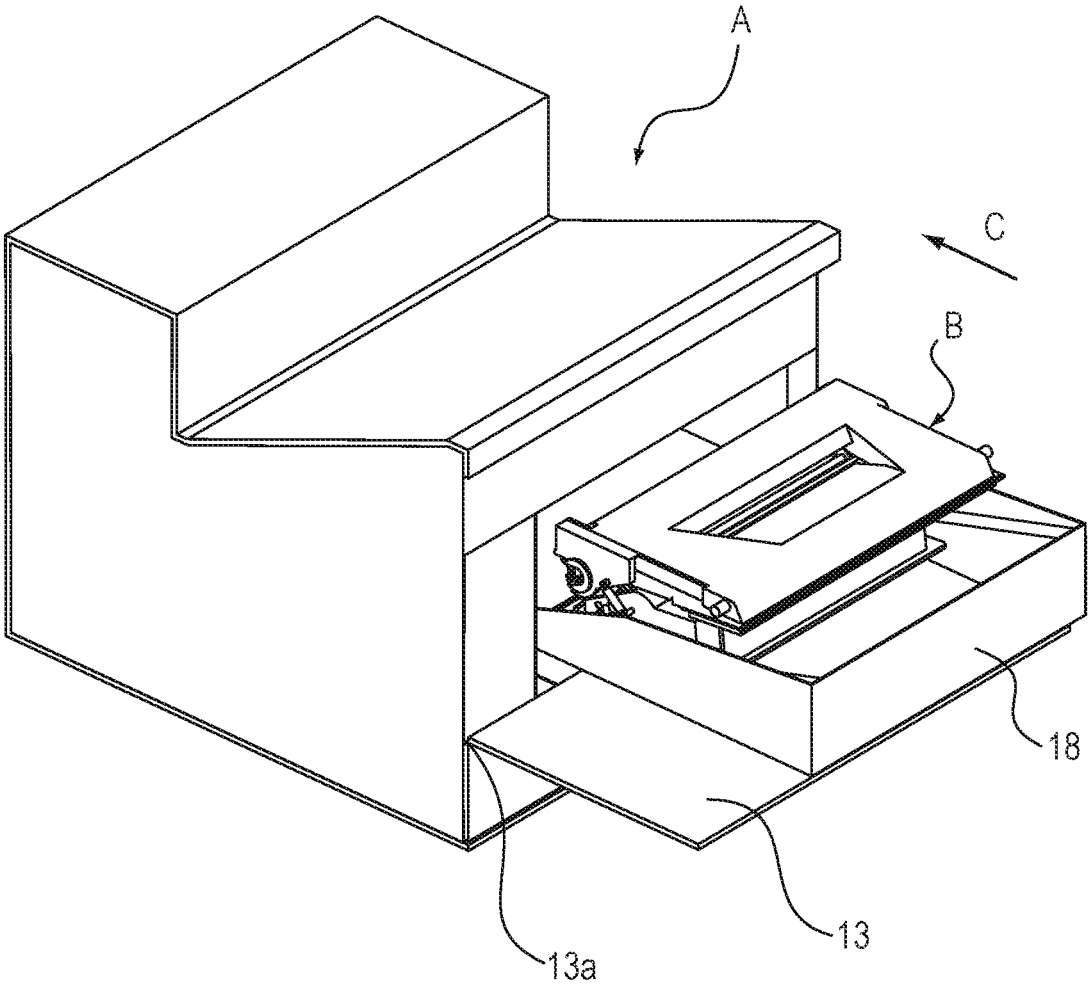
FIG. 4 is an explanatory perspective view for illustrating a state in which the openable and closable door of the image forming apparatus is opened to pull out a tray according to this embodiment.
Figure 5:
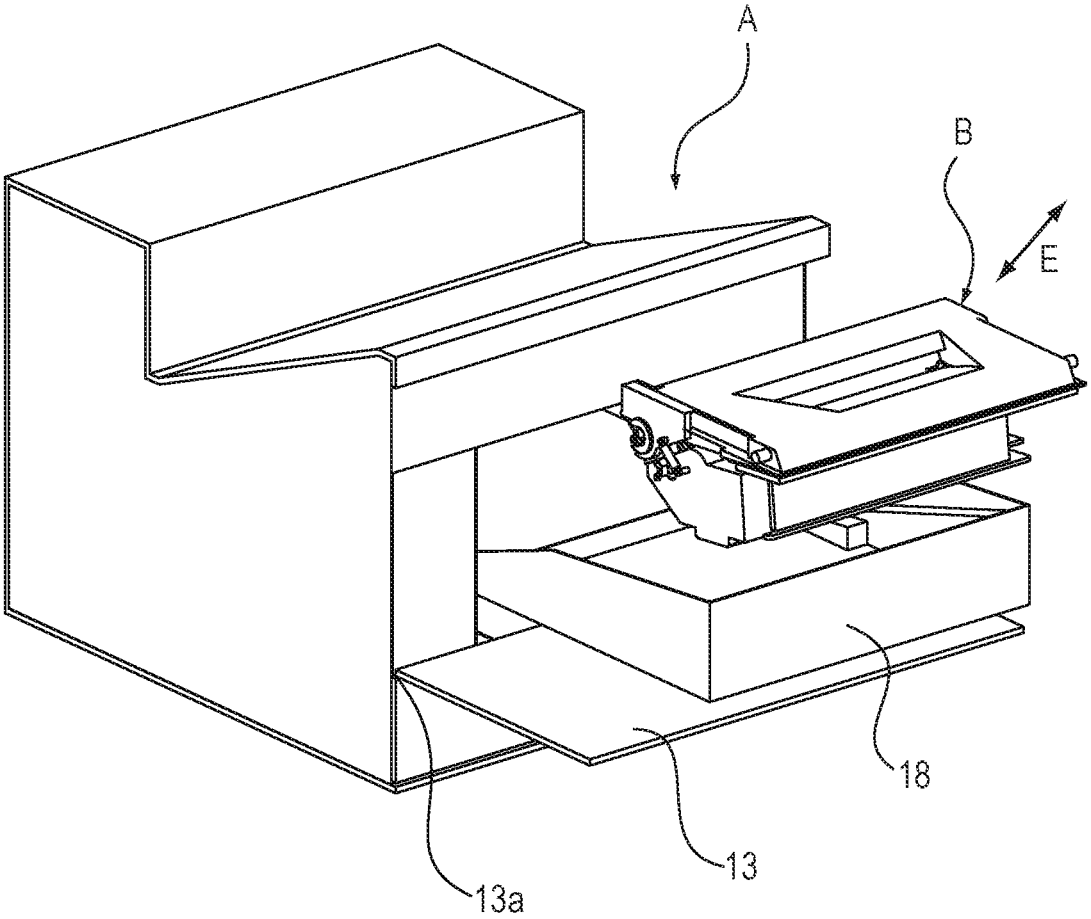
FIG. 5 is an explanatory perspective view for illustrating a circumstance of mounting or removing the process cartridge with respect to the tray under the state in which the openable and closable door of the image forming apparatus is opened to pull out the tray according to this embodiment.

Next, with reference to FIG. 3 to FIG. 6, description is made of operations of mounting and removing the process cartridge B with respect to the image forming apparatus A main body. FIG. 3 is an explanatory perspective view for illustrating a circumstance in which an openable and closable door 13, which is openably and closably arranged on the image forming apparatus A main body to enable mounting and removing of the process cartridge B, is opened. FIG. 4 is an explanatory perspective view for illustrating a circumstance in which the openable and closable door 13, which is openably and closably arranged on the image forming apparatus A main body to enable mounting and removing of the process cartridge B, is opened to pull out a tray 18. FIG. 5 is an explanatory perspective view for illustrating a circumstance of mounting or removing the process cartridge B with respect to the tray 18 under a state in which the openable and closable door 13 is opened to pull out the tray 18. As illustrated in FIG. 5, the process cartridge B is mountable and removable with respect to the tray 18 along a mounting and removing direction E.

As illustrated in FIG. 3, FIG. 4 and FIG. 5, the openable and closable door 13, which is arranged so as to be rotatable about a hinge portion 13*a*, is mounted to the image forming apparatus A main body. When the openable and closable door 13 is opened, a cartridge insertion port 17 is exposed. In the cartridge insertion port 17, the tray 18 for use in mounting the process cartridge B to the image forming apparatus A main body is arranged so that the tray can be pulled out with respect to the image forming apparatus A main body through intermediation of a guide rail (not shown). When the tray 18 is pulled out to a predetermined position illustrated in FIG. 5, the process cartridge B can be mounted or removed. As illustrated in FIG. 4, the process cartridge B is mounted to the image forming apparatus A main body along the guide rail (not shown) in the direction of the arrow C of FIG. 4 under a state in which the process cartridge B is placed on the tray 18.

Figure 6:
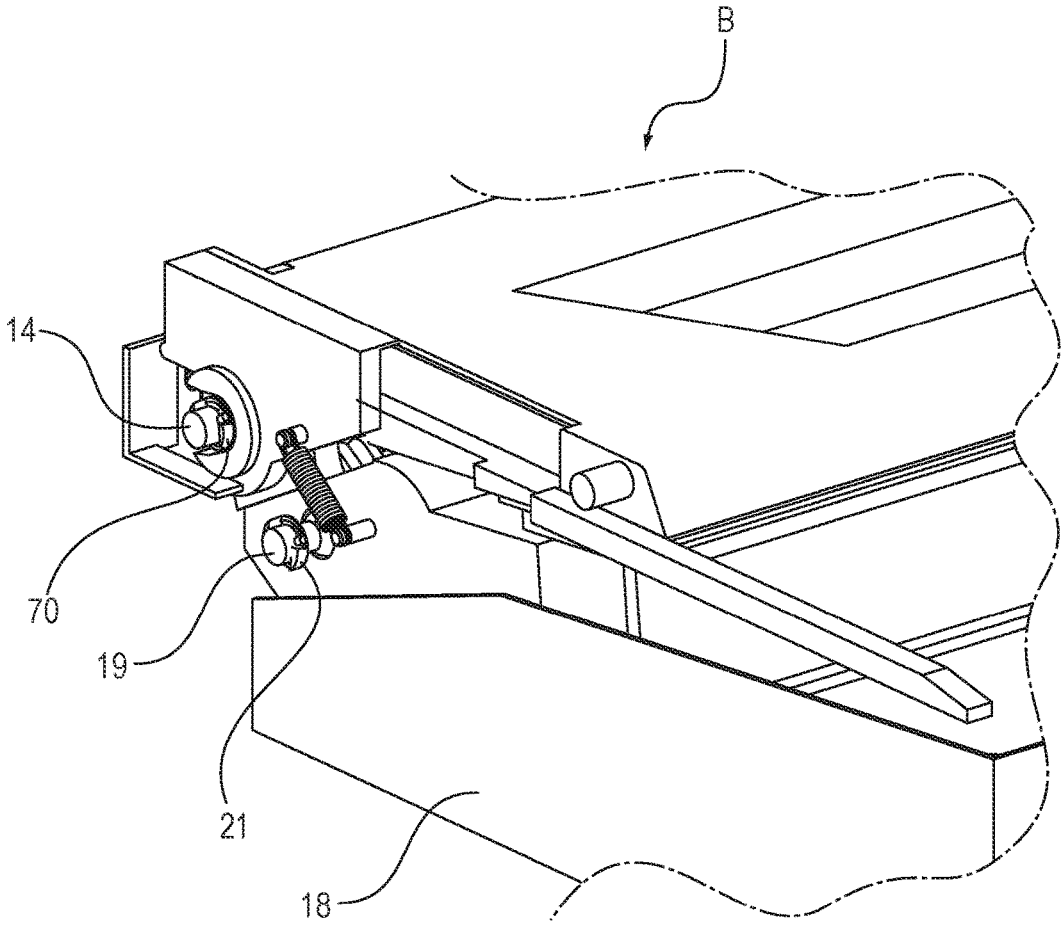
FIG. 6 is an explanatory perspective view for illustrating a configuration of a drive unit under a state in which the process cartridge is mounted to the image forming apparatus according to this embodiment.

As illustrated in FIG. 6, in the process cartridge B, there are arranged a first coupling 70 configured to transmit a rotational driving force to the photosensitive drum 62, and a second coupling 21 configured to transmit a rotational driving force to the developing roller 32. There are arranged a first drive shaft 14 and a second drive shaft 19, which are configured to transmit rotational driving forces to the first coupling 70 and the second coupling 21, respectively. The first drive shaft 14 and the second drive shaft 19 are driven to rotate by a motor (not shown), which serves as a drive source and is arranged in the image forming apparatus A main body.

<Process Cartridge>

Figure 7:
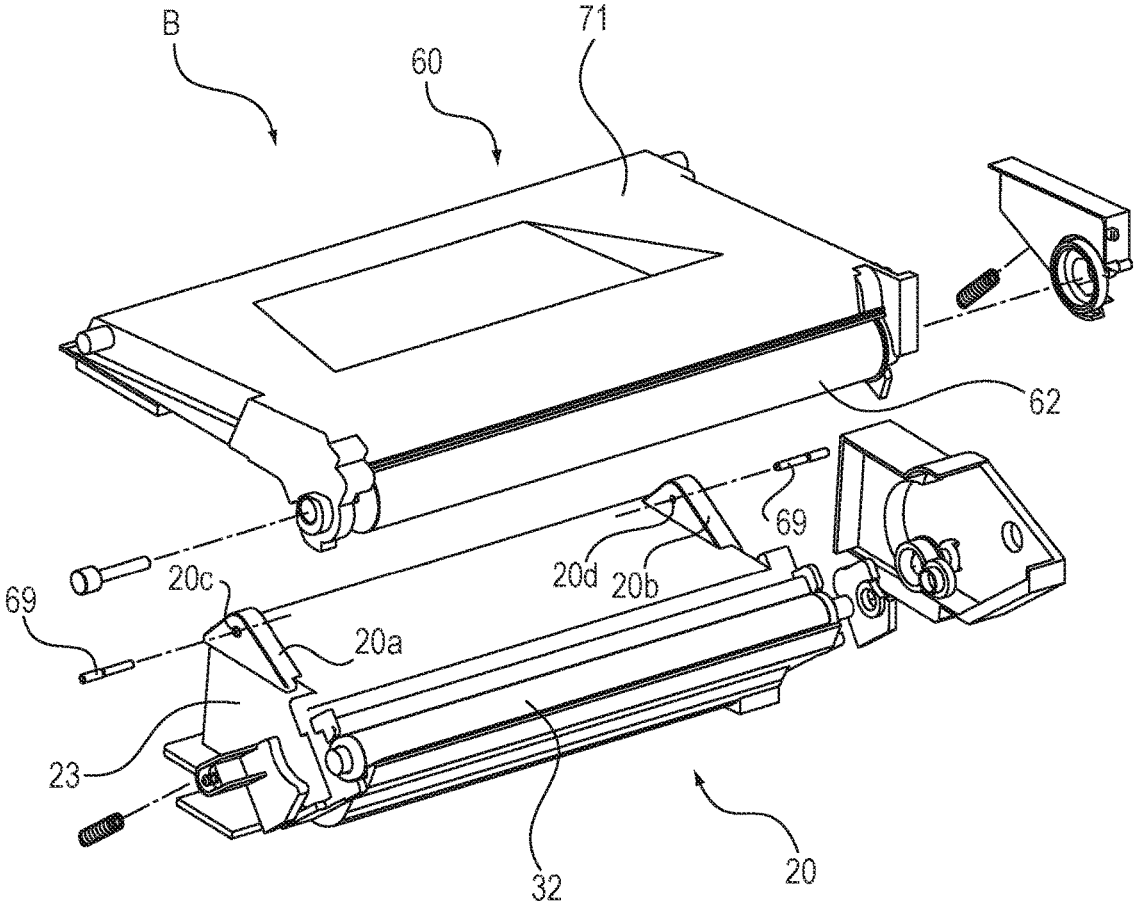
FIG. 7 is an exploded perspective view for illustrating the process cartridge according to this embodiment.

Next, with reference to FIG. 2 and FIG. 7, a configuration of the process cartridge B is described. FIG. is an explanatory sectional view for illustrating a configuration of the process cartridge B. FIG. 7 is an exploded perspective view for illustrating the configuration of the process cartridge B. In the following description, description as to screws configured to connect components is omitted. As illustrated in FIG. 2 and FIG. 7, the process cartridge B of this embodiment includes the cleaning unit 60 and the developing device 20.

In general, the process cartridge B integrally includes as cartridge the photosensitive drum 62 and at least one of the charging unit, the developing unit, and the cleaning unit, which serve as image forming process units which are configured to act on the photosensitive drum 62. The process cartridge B is removably mounted to the image forming apparatus A main body. The process cartridge B of this embodiment includes the cleaning unit 60 having at least the photosensitive drum 62.

As illustrated in FIG. 2, the cleaning unit 60 includes the photosensitive drum 62, the charging roller 66, the cleaning blade 77, the cleaning frame body 71 configured to support those, and a cover member 72 fixed to the cleaning frame body 71 through welding. In the cleaning unit 60, the charging roller 66 and the cleaning blade 77 are arranged in contact with the surface of the photosensitive drum 62. The photosensitive drum 62 receives a rotational driving force, which is transmitted through intermediation of the first coupling 70 illustrated in FIG. 6 from the motor (not shown) serving as a drive source arranged on the image forming apparatus A main body side, to be driven to rotate in the direction of the arrow R of FIG. 2 in accordance with the image forming operation.

As illustrated in FIG. 2, the developing device includes the developing roller 32, the developer container 12 which rotatably supports the developing roller 32, and the developing blade 42. The magnet roller 34 is arranged in the developing roller 32. Further, in the developing device 20, there is arranged the developing blade 42 configured to regulate the layer thickness of the toner T borne on the surface of the developing roller 32. As illustrated in FIG. 7, the process cartridge B is constructed by rotatably coupling the cleaning unit 60 and the developing device 20 to each other with coupling pins 69.

The coupling pins 69 are allowed to pass through through-holes 20*c* and 20*d* penetrating through coupling portions 20*a* and 20*b* arranged on the developing device 20 side, thereby being locked at locking holes formed in coupling portions (not shown) arranged on the cleaning unit side. With this, the cleaning unit 60 and the developing device 20 are coupled to each other so as to be rotatable about the coupling pins 69 being a rotation center.

<Configuration in Periphery of Stirring Chamber 29 in Developer Container 12>

Figure 8:
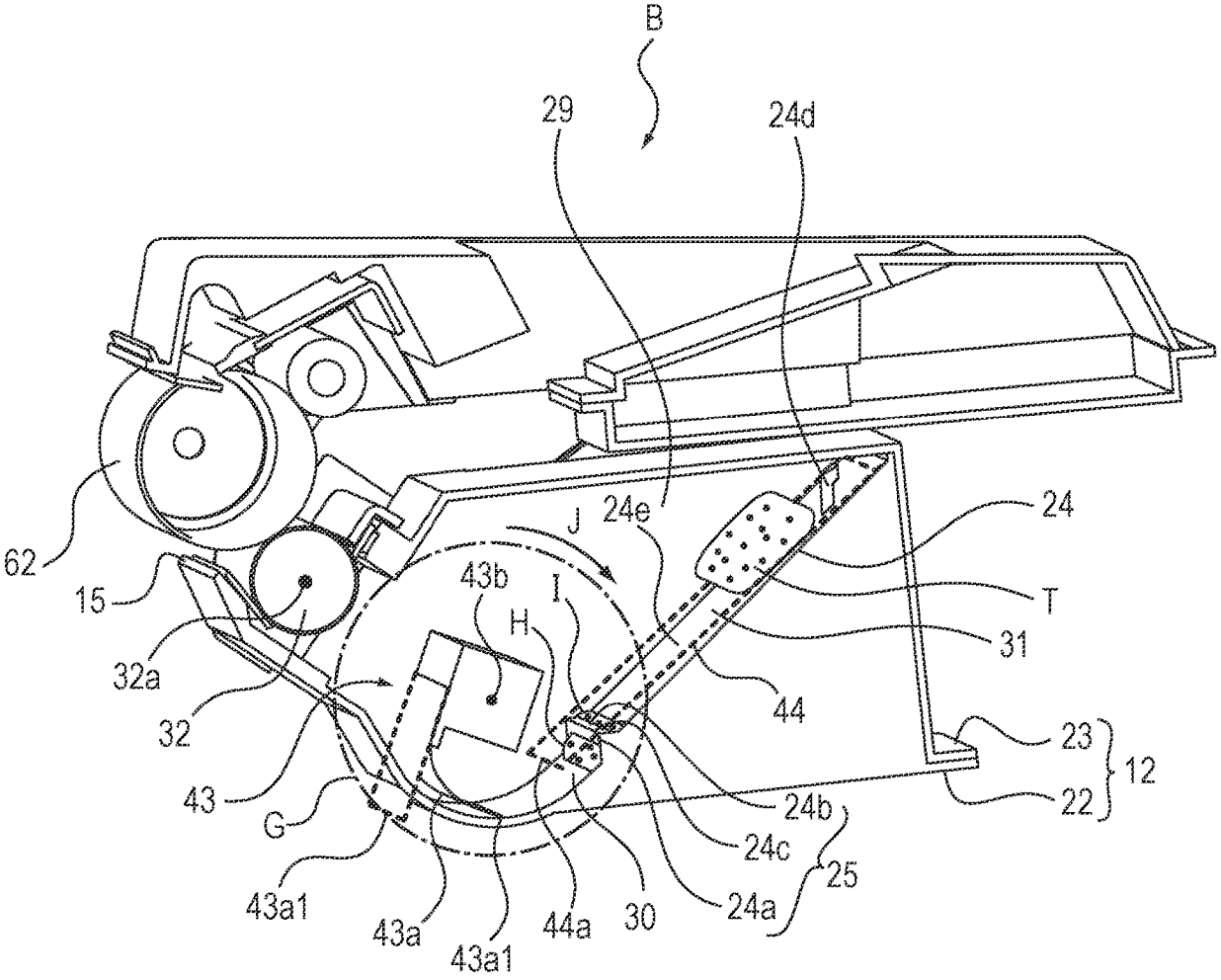
FIG. 8 is an explanatory perspective view for illustrating behavior of a developer in the developer container under a state in which the process cartridge takes a posture of being mounted to an image forming apparatus main body according to this embodiment.
Figure 9A:
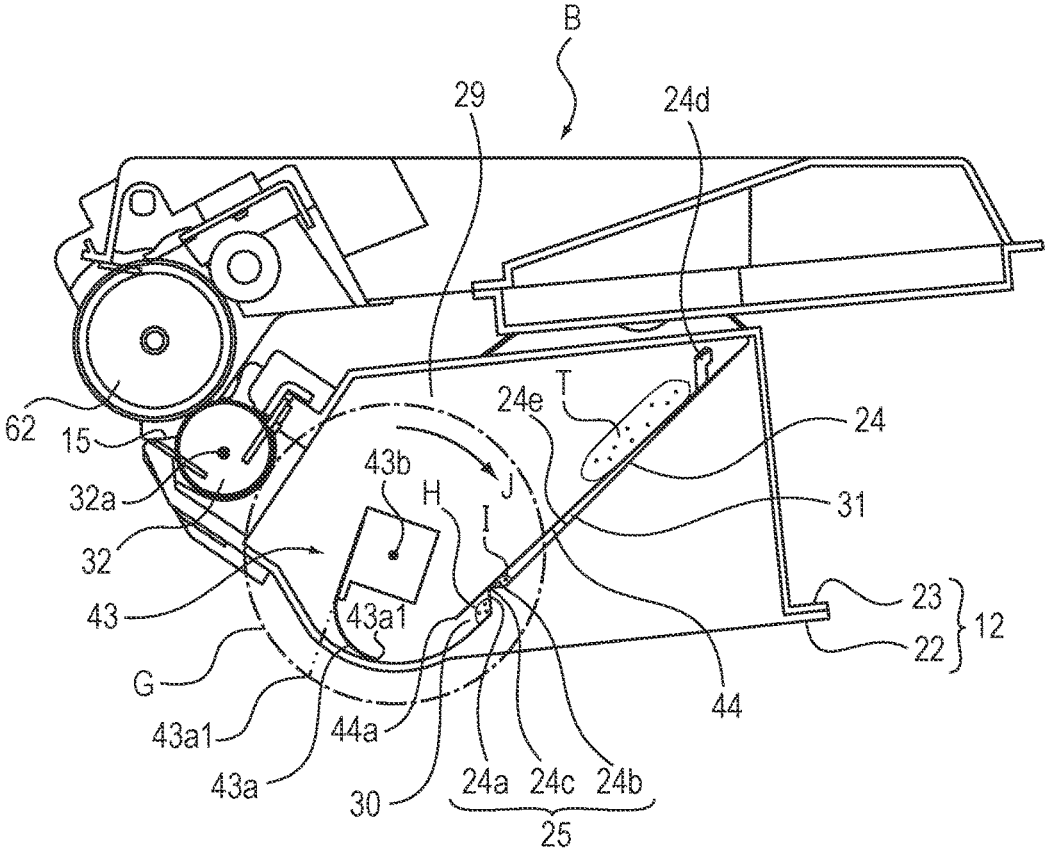
FIG. 9A is an explanatory sectional view for illustrating behavior of the developer in the developer container under the state in which the process cartridge takes the posture of being mounted to the image forming apparatus main body according to this embodiment.
Figure 9B:
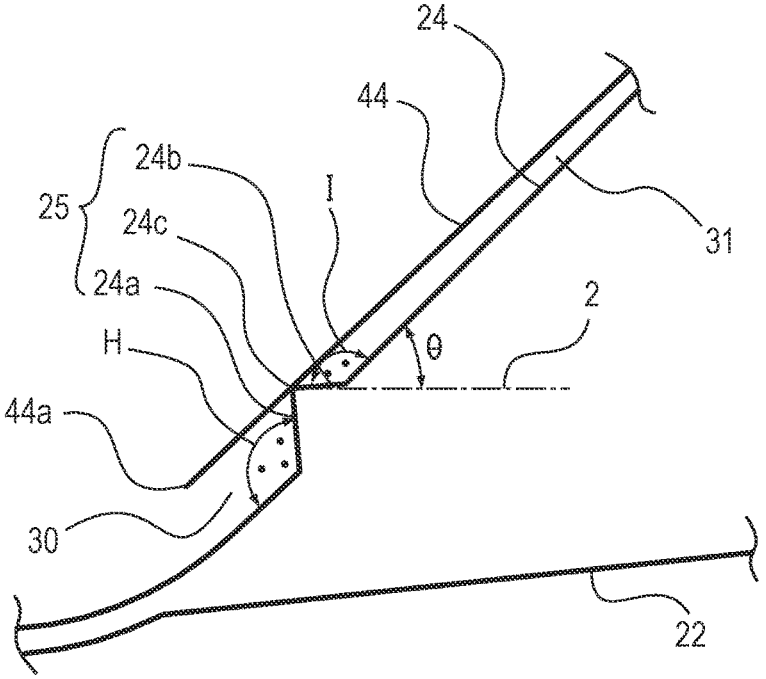
FIG. 9B is a partial enlarged view of FIG. 9A.

Next, with reference to FIG. 8, FIG. 9A and FIG. 9B, description is made of a configuration in the periphery of the stirring chamber 29 in the developer container 12. FIG. 8 is an explanatory perspective view for illustrating the configuration in the periphery of the stirring chamber 29 in the developer container 12 under a state in which the process cartridge B takes a posture of being mounted to the image forming apparatus A main body. FIG. 9A an explanatory sectional view for illustrating the configuration in the periphery of the stirring chamber 29 in the developer container 12 under the state in which the process cartridge B takes the posture of being mounted to the image forming apparatus A main body. FIG. 9B is a partial enlarged view of FIG. 9A. As illustrated in FIG. 8, FIG. 9A and FIG. 9B, the stirring chamber 29 in the developer container 12 is formed by the upper container 23 and the bottom member 22. That is, the upper container 23 and the bottom member 22 correspond to frame bodies of the developer container 12.

In the stirring chamber 29, there is arranged the conveyance member 43 which is arranged so as to be rotatable in a direction of the arrow J of FIG. 8 and FIG. 9A about a rotation center 43*b* with respect to the developer container 12 including the frame bodies. Further, in the stirring chamber 29, there is arranged the vibration member 44 which is configured to convey the toner T in the direction toward the conveyance member 43 with vibration caused by rotation of the conveyance member 43. The conveyance member 43 is arranged on the developing roller 32 side in the stirring chamber 29. A flexible sheet-like conveyance sheet 43*a* is mounted to the conveyance member 43. The conveyance sheet 43*a* is rotated integrally with the conveyance member 43 about the rotation center 43*b* in the direction of the arrow J of FIG. 8 and FIG. 9A. As illustrated in FIG. 9A, the conveyance sheet 43*a* is deformed through contact with an inner wall surface of the bottom member 22 being the frame body (inner wall surface of the stirring chamber 29) to convey the toner T.

The bottom member 22 has an inclined portion 24. The inclined portion 24 has an inclined surface 24*e* which is inclined at a predetermined inclination angle with respect to a vertical direction corresponding to the up-and-down direction in FIG. 9A and FIG. 9B. An inclination angle θ of the inclined surface 24*e* with respect to a horizontal plane 2 is set so as to be smaller than an angle of repose for the toner T. The angle of repose is an angle of an inclined surface at which the toner T maintains stability without spontaneous collapse. The inclined surface 24*e* has fixing bosses 24*d* (corresponding to mounting portions or fixing portions)

protruding therefrom. The inclined surface 24*e* of the inclined portion 24 has a protruding portion 25 which protrudes from the inclined surface 24*e* toward the conveyance member 43. As illustrated in FIG. 9A, under the state in which the process cartridge B takes the posture of being mounted to the image forming apparatus A main body, the inclined surface 24*e* inclines downward from an outside of a region of a rotation locus G of a distal edge 43*a*1 of the conveyance member 43 to an inside of the region.

Under the state in which the process cartridge B takes the posture of being mounted to the image forming apparatus A main body, the protruding portion 25 has a first inclined surface 24*a* protruding from the inclined surface 24*e* of the inclined portion 24 toward an upper side of FIG. 9A and FIG. 9B. Further, the protruding portion 25 has a second inclined surface 24*b* protruding from the inclined surface 24*e* of the inclined portion 24 toward the conveyance member 43 illustrated in FIG. 9A. The first inclined surface 24*a* and the second inclined surface 24*b* intersect each other at a top 24*c*. That is, the first inclined surface 24*a* and the second inclined surface 24*b* are adjacent to each other at the top 24*c* as a boundary. In other words, the top 24*c* is an edge (a corner portion) between the first inclined surface 24*a* and the second inclined surface 24*b* adjacent to each other.

An angle H formed between the inclined surface 24*e* of the inclined portion 24 and the first inclined surface 24*a* of the protruding portion 25 illustrated in FIG. 9A and FIG. 93 is an obtuse angle. Further, an angle I formed between the inclined surface 24*e* of the inclined portion 24 and the second inclined surface 24*b* of the protruding portion 25 illustrated in FIG. 9A and FIG. 9B is also an obtuse angle. As illustrated in FIG. 8, the protruding portion 25 is formed linearly in the longitudinal direction (axis direction of the rotation center 43*b* of the conveyance member 43).

Figure 13:
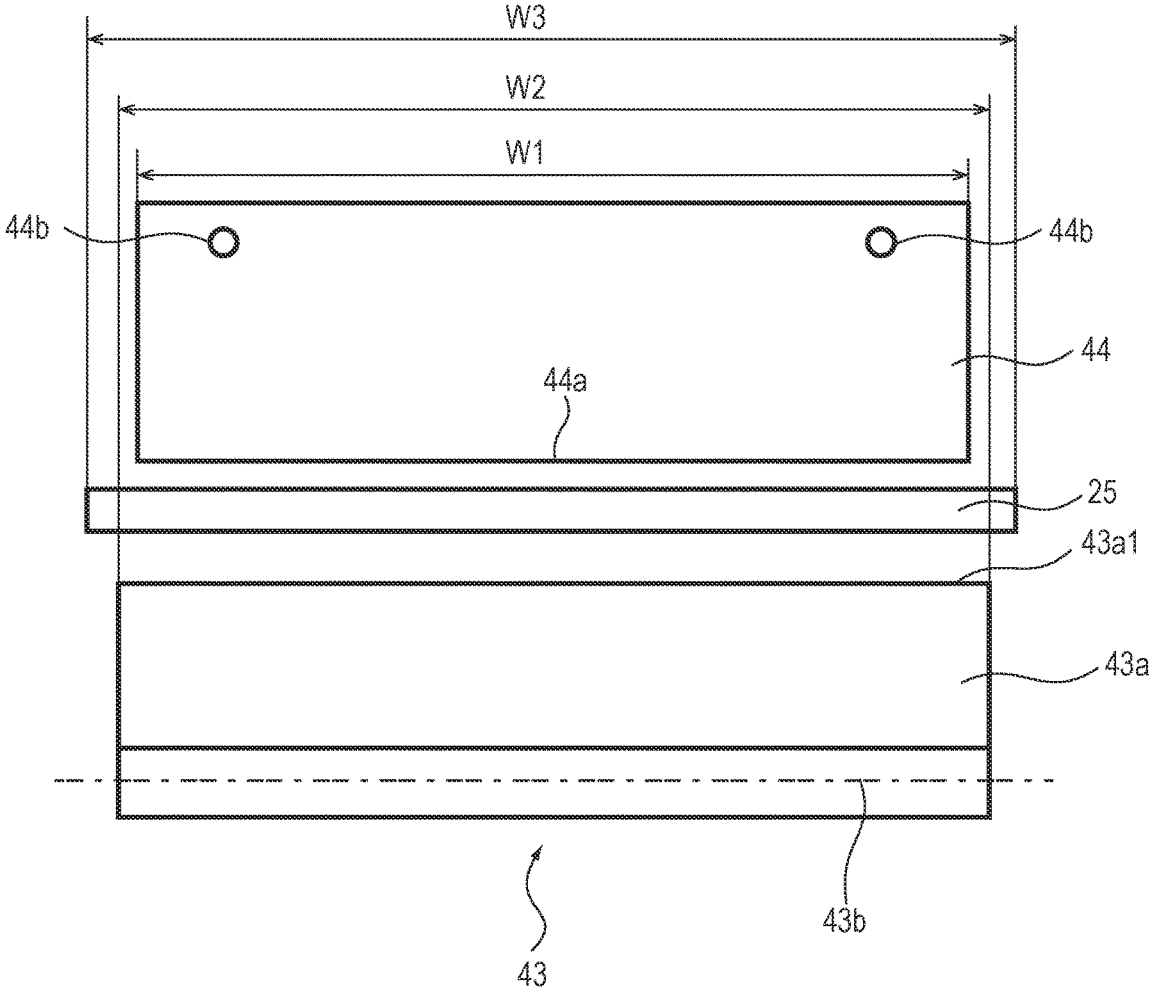
FIG. 13 is a view for illustrating a dimensional relationship of the developer container in a longitudinal direction according to this embodiment.

Now, with reference to FIG. 13, description is made of a dimensional relationship among the protruding portion 25, the conveyance member 43, and the vibration member 44 in the longitudinal direction (axis direction of the rotation center 43*b* of the conveyance member 43). FIG. 13 is a view for illustrating the dimensional relationship of the developer container 12 in the longitudinal direction. As illustrated in FIG. 13, in the axis direction (longitudinal direction) of the conveyance member 43, a length W3 of the protruding portion 25 is larger than a length W2 of the distal edge 43*a*1 of the conveyance member 43 and a length W1 of the vibration member 44. With this, the vibration member 44 can vibrate in a wider range. Fixing holes 44*b* of FIG. 13 are engaged with the fixing bosses 24*d*.

The angle I formed between the inclined surface 24*e* of the inclined portion 24 and the second inclined surface 24*b* of the protruding portion 25, which are illustrated in FIG. 9A and FIG. 9B, is an obtuse angle. With this, the toner T having entered a second gap 31 between the vibration member 44 and the inclined surface 24*e* of the inclined portion 24 can also be conveyed in the direction toward the conveyance member 43 along the second inclined surface 24*b*. As illustrated in FIG. 9A, the opening 15 is arranged in a height direction toward the top 24*c* of the protruding portion 25. Further, the rotation center 32*a* of the developing roller 32 and the rotation center 43*b* of the conveyance member 43 are sequentially arranged between the top 24*c* and the opening 15 from a side close to the opening 15.

The angle I formed between the inclined surface 24*e* of the inclined portion 24 and the second inclined surface 24*b* of the protruding portion 25, which are illustrated in FIG. 9A and FIG. 9B, is an obtuse angle. With this, the toner T having remained in the second gap 31 is more easily conveyed in the direction toward the conveyance member 43 (forward). The vibration member 44 is a flexible sheet-like member, which is made of a material such as polyethylene terephthalate, polycarbonate, polyester, polyacetal, or polyphenylene sulfide and has a thickness of from 10 μm to 200 μm.

As illustrated in FIG. 8 and FIG. 9A, the fixing holes (not shown and corresponding to mounted portions) formed in the vibration member 44 are engaged with the fixing bosses 24*d* protruding from the inclined surface 24*e* of the inclined portion 24 formed on the bottom member 22. With this, the vibration member 44 is arranged in a vibratable manner along the inclined surface 24*e* of the inclined portion 24 of the bottom member 22 opposed to the conveyance member 43 in the developer container 12. As illustrated in FIG. 8 and FIG. 9A, under the state in which the process cartridge B takes the posture of being mounted to the image forming apparatus A main body, a distal edge 44*a* of the vibration member 44, which is positioned on the conveyance member 43 side as viewed from the fixing bosses 24*d*, is positioned below the fixing bosses 24*d*. The distal edge 44*a* of the vibration member 44 is arranged apart from the inner wall of the bottom member 22 (inner wall of the stirring chamber 29) and from the inclined surface 24*e*.

As illustrated in FIG. 8 and FIG. 9A, the state in which the conveyance member 43 is not in contact with the vibration member 44 and in which the vibration member 44 is in contact with the top 24*c* of the protruding portion 25 is as follows. A first gap 30 and the second gap 31 are formed between the vibration member 44 and the inclined surface 24*e* of the inclined portion 24 with the protruding portion 25 as a boundary. The vibration member 44 is held in contact with the top 24*c* of the protruding portion 25, which is formed on the inclined surface 24*e* to protrude therefrom, on the conveyance member 43 side of the inclined portion 24. In this state, between the vibration member 44 and the inclined surface 24*e* of the inclined portion 24, there are formed the first gap 30 on the conveyance member 43 side with respect to the protruding portion 25, and the second gap 31 on the fixing bosses 24*d* side with respect to the protruding portion 25. That is, as illustrated in FIG. 8 and FIG. 9A, the first gap 30 and the second gap 31 are formed with the protruding portion 25 as a boundary in the direction orthogonal to the axis direction of the conveyance member 43.

Next, with reference to FIG. 9A, description is made of a positional relationship among the rotation locus G of the distal edge 43*a*1 of the conveyance member 43, the first gap 30, and the second gap 31. As illustrated in FIG. 92, the conveyance member 43 is rotated in the direction of the arrow J of FIG. 9A about the rotation center 43*b* by a rotational driving force transmitted from the motor (not shown) arranged in the image forming apparatus A main body.

With this, the distal edge 43*a*1 of the flexible conveyance sheet 43*a* arranged on the conveyance member 43 is rotated as follows. An imaginary state of the conveyance sheet 43*a*, which is not in contact with the inner wall surface of the developer container 12 and linearly extends as indicated by the one-dot chain line, is assumed. In this case, the distal edge 43*a*1 moves on the rotation locus G illustrated in FIG. 9A with a circle having a center at the rotation center 43*b*. In this case, at least a part of the first gap 30 and the second gap 31 with the protruding portion 25 as a boundary illustrated in FIG. 9A is formed in an inside region of the rotation locus G (inside of the region of the rotation locus) of the distal edge 43*a*1 of the conveyance sheet 43*a*. As illustrated in FIG. 9A, in the rotation direction J of the conveyance member 43, the second gap 31 is located on upstream of the protruding portion 25. The first gap 30 is located on downstream of the protruding portion 25. Under the state in which the process cartridge B takes the posture of being mounted to the image forming apparatus A main body, the second gap 31 is located above the first gap 30.

Next, with reference to FIG. 8 to FIG. 12, the rotation operation of the conveyance member 43 and the vibration operation of the vibration member 44 are described. FIG. 8 and FIG. 9A are explanatory sectional views for illustrating a first state in which the conveyance sheet 43*a* of the conveyance member 43 and the vibration member 44 are not in contact with each other. As illustrated in FIG. 8 and FIG. 9A, when the conveyance member 43 and the vibration member 44 are not in contact with each other, the vibration member 44 is in contact with the top 24*c* of the protruding portion 25. At this time, the toner T in the stirring chamber 29 remains on an upper side on the surface of the vibration member 44 arranged on the inclined portion 24.

Figure 10:
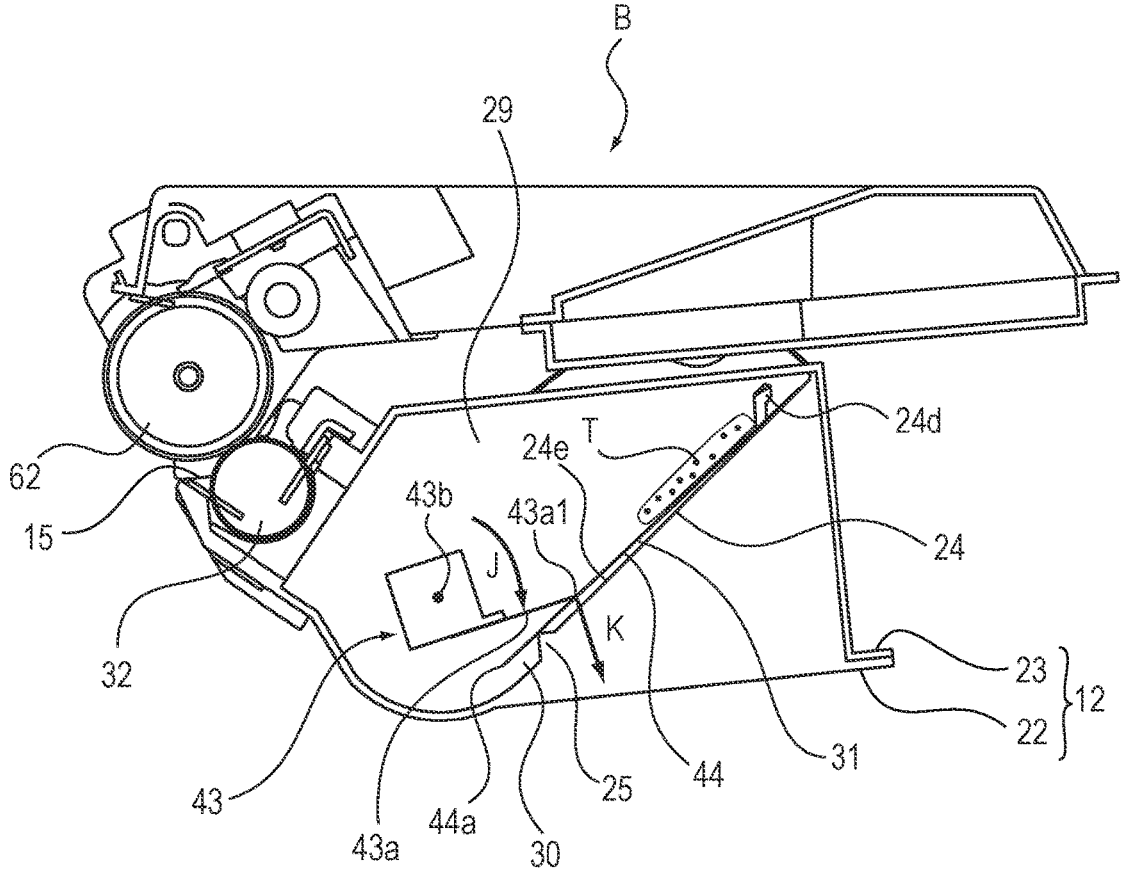
FIG. 10 is an explanatory sectional view for illustrating behavior of the developer in the developer container of the process cartridge according to this embodiment.

Next, the conveyance member 43 is rotated in the direction of the arrow J of FIG. 10 from the first state illustrated in FIG. 9A. Thus, the distal edge 43*a*1 of the conveyance sheet 43*a* is brought into the second state of being in contact with the vibration member 44 as illustrated in FIG. 10. At this time, the first gap 30 and the second gap 31 are formed between the vibration member 44 and the inclined surface 24*e* of the inclined portion 24. The vibration member 44 receives a force in a direction of the arrow K of FIG. 10 from the distal edge 43*a*1 of the conveyance sheet 43*a*.

Figure 11:
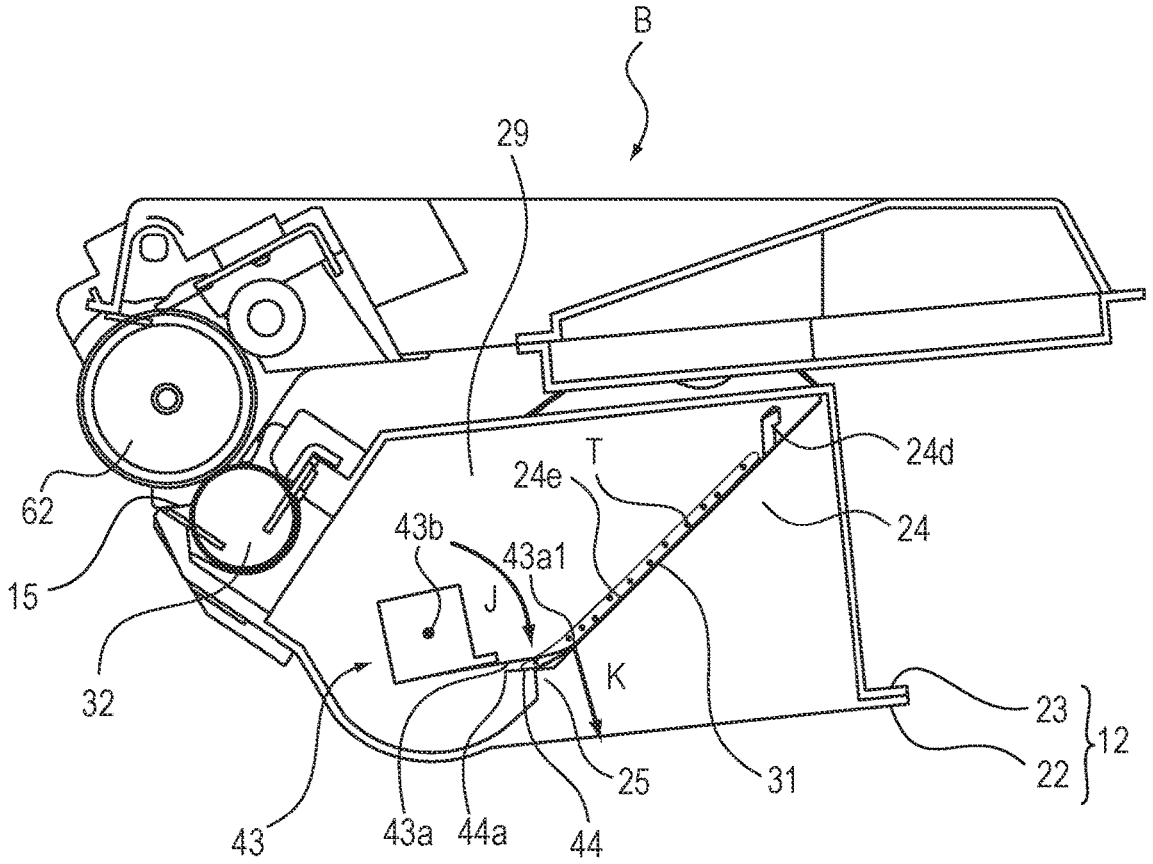
FIG. 11 is an explanatory sectional view for illustrating behavior of the developer in the developer container of the process cartridge according to this embodiment.

Next, the conveyance member 43 is further rotated in the direction of the arrow J of FIG. 11 from the second state illustrated in FIG. 10. Thus, as illustrated in FIG. 11, the distal edge 43*a*1 of the conveyance sheet 43*a* presses the flexible vibration member 44 in the direction of the arrow K of FIG. 11. With this, the vibration member is flexed to be in close contact with the inclined surface 24*e* of the inclined portion 24.

At this time, the distal edge 43*a*1 of the conveyance sheet 43*a* causes the flexible vibration member to flex until the flexible vibration member 44 is brought into the state of being convex toward the inclined surface 24*e* side of the inclined portion 24. With this, the flexible vibration member 44 is brought into a third state of having entered the region of the second gap 31 illustrated in FIG. 10. At this time, the distal edge 43*a*1 of the conveyance sheet 43*a* and the vibration member 44 are brought into contact with each other, with the result that the vibration member 44 continuously receives a force in the direction of the arrow K of FIG. 11 from the distal edge 43*a*1 of the conveyance sheet 43*a*. Thus, the flexible vibration member 44 is flexed to deform.

The vibration member 44 vibrates through deformation from the second state illustrated in FIG. 10 to the third state illustrated in FIG. 11 in which the vibration member 44 is brought into the state of being convex toward the inclined surface 24*e* side of the inclined portion 24. With this, the toner T having remained on the upper side on the surface of the vibration member 44 as illustrated in FIG. 10 is conveyed toward the lower side of FIG. 11 by its own weight along the surface of the vibration member 44 which has been deformed into the state of being convex toward the inclined surface 24*e* side of the inclined portion 24 (convex toward the right side of FIG. 11), as illustrated in FIG. 11. As illustrated in FIG. 11, when the vibration member 44 is brought into the state of being convex toward the inclined surface 24*e* side of the inclined portion 24 (convex toward the right side of FIG. 11), the top of the convex portion is positioned more apart from the opening 15 than the protruding portion 25.

That is, vibration can be applied to the vibration member 44 on an upper side in the stirring chamber 29. Thus, even when the toner T in the stirring chamber 29 is reduced, the toner T which remains on the upper side it the stirring chamber 29 can reliably be conveyed to the lower side of FIG. 11 by its own weight along the surface of the vibration member 44. With this, the toner 17 in the stirring chamber 29 can be used up.

Figure 12:
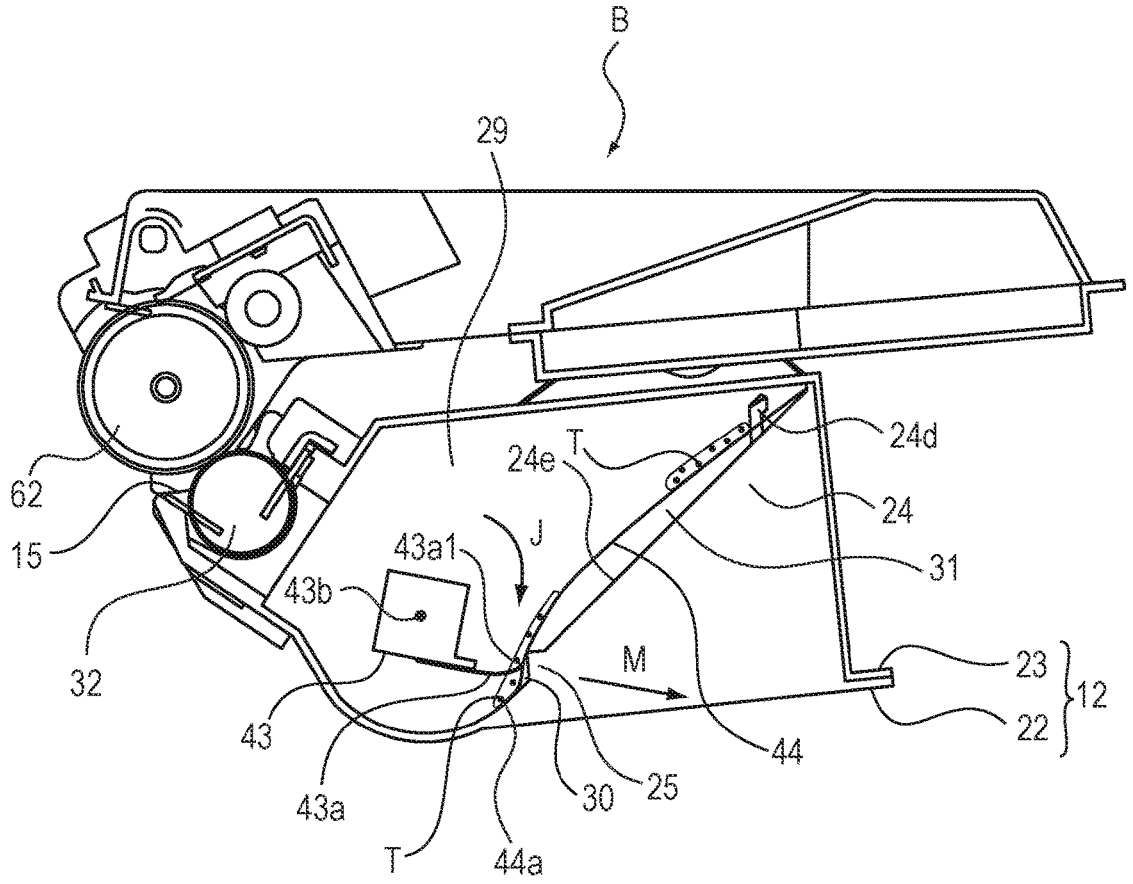
FIG. 12 is an explanatory sectional view for illustrating behavior of the developer in the developer container of the process cartridge according to this embodiment.

Next, with reference to FIG. 12, a fourth state is described. As illustrated in FIG. 11, the conveyance member 43 is further rotated in the direction of the arrow J of FIG. 12 from the third state in which the vibration member 44 is brought into the state of being convex toward the inclined surface 24*e* side of the inclined portion 24. Thus, as illustrated in FIG. 12, the distal edge 43*a*1 of the conveyance sheet 43*a* goes over the protruding portion 25 to press and flex the flexible vibration member 44 in a direction of the arrow M of FIG. 12, and enters the region of the first gap 30 illustrated in FIG. 10. At this time, as illustrated in FIG. 12, the conveyance member 43 is deformed to go over the protruding portion 25.

With this, the vibration member 44 is brought into the fourth state of being deformed into the state of being convex toward the conveyance member 43 side (left side of FIG. 12), which is a side opposite to the inclined surface 24*e*, with the top 24*c* of the protruding portion 25 as a fulcrum. At this time, the vibration member 44 receives, on the distal edge 44*a* side on the lower side of FIG. 12 with respect to the top 24*c* of the protruding portion 25 as the fulcrum, a force from the distal edge 43*a*1 of the conveyance sheet 43*a* in the direction of the arrow M to deform.

The vibration member 44 is deformed from the third state, in which the vibration member 44 is brought into the state of being convex toward the inclined surface 24*e* side of the inclined portion 24 (convex toward the right side of FIG. 11) as illustrated in FIG. 11, to the fourth state, in which the vibration member 44 is convex toward the conveyance member 43 side (left side of FIG. 12) as illustrated in FIG. 12. With this, vibration is generated in the vibration member 44. Thus, as illustrated in FIG. 12, the toner T on the surface of the vibration member 44 is conveyed by its own weight toward the lower side in the stirring chamber 29.

When the conveyance member 43 is further rotated from the fourth state illustrated in FIG. 12 in the direction of the arrow J of FIG. 12, the contact between the conveyance sheet 43*a* and the vibration member 44 is released. With this, the flexure of the vibration member 44 is released, with the result that the vibration member 44 returns to the first state illustrated in FIG. 8 and FIG. 9A. At this time, a restoration force of releasing the flexure of the vibration member 44 causes vibration in the vibration member 44. Then, the toner T on the surface of the vibration member 44 illustrated in FIG. 12 is conveyed by its own weight in the direction toward the conveyance member 43.

In this embodiment, the conveyance member 43 is brought into contact with the vibration member 44. Thus, in accordance with the rotation phase of the conveyance member 43, the vibration member 44 is brought into the state of being convex toward the inclined surface 24*e* side of the inclined portion 24 (inclined surface side) and into the state of being convex toward the side opposite to the inclined surface 24*e*. The flexible vibration member 44 is deformed along with the rotation of the conveyance member 43, and more vibration is given to the vibration member 44. With this, the toner T on the upper side on the surface of the vibration member 44 can reliably be conveyed by its own weight in the direction toward the conveyance member 43.

The distal edge 43*a*2 of the conveyance sheet 43*a* of the conveyance member 43 is brought to enter the region of the second gap 31 which is formed between the inclined surface 24*e* of the inclined portion 24 and the vibration member 44. With this, the vibration member 44 can be flexed until the vibration member 44 is brought into the state of being convex toward the inclined surface 24*e* side of the inclined portion 24. With this, even when the remaining toner T in the stirring chamber 29 is reduced, the toner on the upper side on the surface of the vibration member 44 can reliably be conveyed its own weight in the direction toward the conveyance member 43.

As compared to the configuration of Japanese Patent Application Laid-Open No. 2003-202737, more vibration can be generated in the vibration member 44 by one rotation of the conveyance member 43. With this, the toner T remaining on the surface of the vibration member 44 can more reliably be conveyed in the direction toward the conveyance member 43, thereby being capable of reducing the residual toner T in the developer container 12.

According to the present invention, more vibration can be generated in the vibration member, which is arranged in a vibratable manner along the inclined surface in the developer container, by one rotation of the conveyance member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-030701, filed Feb. 22, 2016, and No. 2017-006586, filed Jan. 18, 2017, which are hereby incorporated by reference herein in their entirety.

What is claimed is:

1. A developer container, comprising:

a conveyance member configured to convey a developer;

a vibration member arranged along an inclined surface opposed to the conveyance member and configured to vibrate through contact with the conveyance member; and a protruding portion protruding from the inclined surface and configured to be held in contact with the vibration member, wherein the conveyance member is a flexible sheet-like member, wherein, under a state in which the vibration member is brought into contact with the protruding portion, a first gap and a second gap are formed between the vibration member and the inclined surface with the protruding portion as a boundary, and wherein at least a part of the first gap and at least a part of the second gap are located in a region of a rotation locus of the conveyance member.

2. The developer container according to claim 1, wherein the protruding portion protrudes from the inclined surface toward the conveyance member.

3. The developer container according to claim 1, wherein the vibration member is brought into a state of being convex toward the inclined surface when the conveyance member is brought into contact with the vibration member.

4. The developer container according to claim 3, wherein the vibration member is brought into a state of being convex toward a side opposite to the inclined surface in accordance with a rotation phase of the conveyance member.

5. The developer container according to claim 1, wherein, under a state in which the developer container is mounted to a main body of an image forming apparatus, the protruding portion has a first inclined surface protruding upward from the inclined surface and a second inclined surface protruding from the inclined surface toward the conveyance member.

6. The developer container according to claim 1, wherein the protruding portion has a first inclined surface and a second inclined surface which protrude from the inclined surface, wherein an angle formed between the inclined surface and the first inclined surface is an obtuse angle, and wherein an angle formed between the inclined surface and the second inclined surface is an obtuse angle.

7. The developer container according to claim 6, wherein the protruding portion extends in a rotation axis direction of the conveyance member.

8. The developer container according to claim 1, wherein the vibration member is a sheet-like member.

9. The developer container according to claim 1, wherein the protruding portion extends in a rotation axis direction of the conveyance member.

10. The developer container according to claim 1, further comprising a fixing portion configured to be engaged with the vibration member, wherein the second gap is located between the fixing portion and the protruding portion.

11. The developer container according to claim 1, wherein, in a rotation direction of the conveyance member, the first gap is located on downstream of the protruding portion and the second gap is located on upstream of the protruding portion.

12. A developing device, comprising:

the developer container according to claim 1; and a developer bearing member arranged in the developer container so as to be opposed to an image bearing member.

13. The developing device according to claim 12, wherein an opening of the developer container is formed in a height direction toward a top of the protruding portion, and wherein a rotation center of the developer bearing member and a rotation center of the conveyance member are sequentially arranged between the top and the opening from a side close to the opening.

14. A process cartridge removably mounted to a main body of an image forming apparatus, comprising:

the developer container according to claim 1; and an image bearing member on which an electrostatic latent image is to be formed.

15. An image forming apparatus configured to form an image on a recording material, comprising:

the developer container according to claim 1 configured to be removably mounted to the image forming apparatus.

16. A developing device, comprising:

a developer bearing member;

a container configured to store a developer and provided with an opening;

a conveyance member arranged in the container and configured to convey the developer;

a vibration member arranged along an inclined surface in the container and configured to vibrate through contact with the conveyance member;

a protruding portion protruding from the inclined surface and configured to be held in contact with the vibration member, wherein the conveyance member is a flexible sheet-like member, wherein, under a state in which the vibration member is held in contact with the protruding portion, a first gap and a second gap are formed between the vibration member and the inclined surface with the protruding portion being a boundary, and wherein at least a part of the first gap and at least a part of the second gap are located in a region of a rotation locus of the conveyance member.

17. The developing device according to claim 16, wherein the vibration member is brought into a state of being convex toward the inclined surface when the conveyance member is brought into contact with the vibration member.

18. The developing device according to claim 17, wherein the vibration member is brought into a state of being convex toward a side opposite to the inclined surface in accordance with a rotation phase of the conveyance member.

19. The developing device according to claim 17, wherein a top of the convex portion is positioned more apart from the opening than the protruding portion when the vibration member is brought into the state of being convex toward the inclined surface.

20. The developing device according to claim 16, wherein the protruding portion has a first inclined surface and a second inclined surface which protrude from the inclined surface, wherein an angle formed between the inclined surface and the first inclined surface is an obtuse angle, and wherein an angle formed between the inclined surface and the second inclined surface is an obtuse angle.

21. The developing device according to claim 20, wherein the protruding portion extends in an axis direction of the conveyance member.

22. The developing device according to claim 16, further comprising a fixing portion configured to fix the vibration member, wherein the second gap is located between the fixing portion and the protruding portion.

* * * * *